US008800136B2

(12) United States Patent
Perera et al.

(10) Patent No.: US 8,800,136 B2
(45) Date of Patent: Aug. 12, 2014

(54) METHOD FOR MAKING AN INSULATED MICROWIRE

(75) Inventors: Willorage Rathna Perera, Raynham, MA (US); Gerald J. Mauretti, Fall River, MA (US)

(73) Assignee: Pascale Industries, Inc., Pine Bluff, AR (US)

( * ) Notice: Subject to any disclaimer, the term of this patent is extended or adjusted under 35 U.S.C. 154(b) by 989 days.

(21) Appl. No.: 12/924,384

(22) Filed: Sep. 27, 2010

(65) Prior Publication Data

US 2011/0030329 A1 Feb. 10, 2011

Related U.S. Application Data

(62) Division of application No. 11/976,196, filed on Oct. 22, 2007, now Pat. No. 7,832,089.

(60) Provisional application No. 60/861,951, filed on Dec. 1, 2006.

(51) Int. Cl.

| | |
|---|---|
| ***H01R 43/00*** | (2006.01) |
| ***D01D 5/34*** | (2006.01) |
| ***H01B 1/02*** | (2006.01) |

(52) U.S. Cl.

CPC ... *H01B 1/02* (2013.01); *D01D 5/34* (2013.01)
USPC ..... 29/825; 264/171.1; 264/172.11; 264/172.17

(58) Field of Classification Search

USPC ..... 29/825; 264/171, 172
See application file for complete search history.

(56) References Cited

U.S. PATENT DOCUMENTS

| | | | | |
|---|---|---|---|---|
| 3,001,265 | A * | 9/1961 | Bundy | 428/373 |
| 3,003,223 | A | 10/1961 | Breen | |
| 3,333,037 | A | 7/1967 | Humphrey et al. | |
| 5,173,366 | A | 12/1992 | Mitamura et al. | |
| 5,248,468 | A * | 9/1993 | Mitamura et al. | 264/104 |
| 5,814,122 | A | 9/1998 | Huang | |
| 7,002,072 | B2 | 2/2006 | Tonucci et al. | |
| 7,295,734 | B2 | 11/2007 | Bayinder et al. | |
| 2004/0222010 | A1 | 11/2004 | Tonucci et al. | |

FOREIGN PATENT DOCUMENTS

| | | |
|---|---|---|
| JP | 51 011909 | 1/1976 |

OTHER PUBLICATIONS

"Metal Fibers", NERAC search report by J. Brule dated May 30, 2006.
"Electrotextiles", NERAC search report by J. Brule dated May 16, 2006.

* cited by examiner

*Primary Examiner* — Carl Arbes
(74) *Attorney, Agent, or Firm* — Michael de Angeli

(57) ABSTRACT

Insulated electrically conductive fibers or microwires of sizes on the order of 1 mil (25 microns) diameter, so as to be suitable for processing into yarns or multi-microwire bundles, for example, for incorporation into conformable fabric products or for use as wearable electronic circuitry are made by coprocessing a core of a lower-melting-point metal within a sheath of a higher-melting-point polymer.

9 Claims, 4 Drawing Sheets

76

78
72
70
80

82
84
74
86

METHOD FOR MAKING AN INSULATED MICROWIRE

This is a divisional application of application Ser. No. 11/976,196, filed Oct. 22, 2007 now U.S. Pat No. 7,832,089 which in turn claimed priority from provisional application Ser. No. 60/861,951, filed Dec. 1, 2006.

CROSS-REFERENCE TO RELATED APPLICATION

This application claims priority from provisional patent application Ser. No. 60/861,951, filed Dec. 1, 2006, and incorporates by this reference Engineered Yarns Company's SBIR Proposal Number A062-175-0107 (the "Proposal"), a copy of which was filed together with provisional application Ser. No. 60/861,951, as well as the Phase I Final Report prepared for that Proposal dated 5 May 2007 (the "Final Report").

FIELD OF THE INVENTION

This invention relates to novel highly electrically conductive fibers or "microwires", comprising a conductive core and an insulating sheath, that are sufficiently small and flexible as to be capable of being processed to form textile threads or yarns, which can in turn be woven, knitted, braided or otherwise processed, for example to produce fabrics used to fabricate various useful products. The invention also relates to several different methods of making these fibers, and to various classes of products that can be made using these products.

BACKGROUND OF THE INVENTION

The prior art has sought for many years to incorporate electrically conductive fibers or threads into fabric, for various desired applications, both military and commercial. What is essentially desired is an insulated, electrically conductive fiber or "microwire" of between 0.0004-0.004 inches, that is, 10-100 microns, in diameter. Ideally the diameter of the microwires would be less than 25 microns, that is, no greater than 0.001 inches. Further desired characteristics are that the resistance of the conductive component of the fiber per unit length be no more than about five times that of copper, to ensure adequate electrical performance, that the diameter of the central conductor be about 60% of the overall fiber diameter, and that the microwire is suitably flexible to be processed into a wearable textile product and sufficiently durable to withstand ordinary use in a garment. Such microwires are contemplated for carrying heating current, carrying data, for providing electromagnetic shielding, for antenna and sensor fabrication, for connection of electronic components secured to the fabric of a garment, and for other uses.

SUMMARY OF THE INVENTION

Two closely related methods of production of "microwires", that is, electrically conductive, insulated fibers as above, are disclosed herein. As noted, the invention also includes the fibers so produced, as well as thread or yarn made from them and all manner of products produced therefrom.

In both methods of production of fibers according to the invention, a lower-melting-point, highly conductive metal central member is co-processed together with a polymeric sheath of a higher-melting-point material to form long lengths of fine insulated wire. That is, as opposed to more typical methods of making insulated wire, wherein a solid metallic conductor or multifilamentary strand is first drawn to size and subsequently insulated by formation of a polymeric insulative sheath thereover, e.g., by extrusion, according to the present invention the metallic conductor and insulative sheath are produced in a single common operation. In effect, the metal of the core is melted while being confined within the polymeric sheath, which is softened sufficiently to permit drawing, so that capillary action within the sheath as the core and sheath materials are codrawn causes the metallic core to form an elongated continuous conductive member insulated by the sheath.

More specifically, and as discussed more fully below and in the Final Report, metals suitable for practice of the invention include indium, indium alloys such as indium/silver and other low melting point, highly conductive metal alloys such as tin/silver/copper or tin/lead. Suitable polymers include Bayer Macrolon 3103 or 6457 polycarbonate or Eastman Chemical Eastar Copolyester (PETG) GN007, as well as other polymers having similar rheologies. These polymers melt and draw well at temperatures of about 500° F. and higher, while indium and the other alloys mentioned melt at considerably lower temperatures; for example, pure indium melts at 314° F.

A first method of producing fibers according to the invention is referred to as the "preform" or "rod-in-tube" method. In laboratory-scale testing of this technique, a cylindrical "preform" was first fabricated comprising a core of, e.g., indium, on the order of 30 mils (0.030", (approximately 750 microns, or 0.75 mm) in diameter disposed in a cylindrical tube of the desired polymer so as to provide a 0.080-0.120" (2-3 mm) layer of the outer polymer over the metallic core. The preform was placed in a tube furnace and heated; a fine bicomponent insulated wire could be drawn from the tip of the preform, out the exit of the tube furnace.

It is envisioned that a plurality of metal core wires could be disposed in a single polymer tube and the whole codrawn, to further control the ratio of metal to polymer in the final product. In a further alternative, multiple preforms, each containing a conductive core in a tube of insulating polymer, might be placed in the tube furnace and similarly co-processed, to yield a single strand containing multiple conductive wires in an integrated insulative sheath.

A second related method of producing fibers according to the invention is referred to as the "double-crucible" method. The metal intended to form the conductive core of the microwire is melted in an inner crucible surrounded by a coaxial outer crucible containing the polymeric material intended to form the insulative sheath. The coaxial crucibles are oriented vertically, with their exit orifices at the lower ends, so that gravity aids in urging the respective molten or semi-molten materials through coaxial exit orifices formed by the crucible tips. Pressure or vacuum may be applied to either or both of the crucibles to aid in stable formation of the conductor and sheath, and the metal and polymer may be heated together or separately, for better control. The sizes of the inner and outer crucible tips must be carefully selected, and their relative axial locations carefully controlled, to provide the appropriate product characteristics. The bicomponent fiber exiting the double crucible may be drawn further to reduce its overall diameter.

Both approaches have their advantages. As will be explained more fully below, the rod-in-tube method has the advantage that a very precise relationship between the diameter of the core wire and the thickness of the insulation can be maintained. In addition, fibers having a desired cross-sectional shape might be made by starting with a preform of the desired shape; for example, a hexagonal preform could be used to make micro-wires that are hexagonal in section, which could then be compacted into tight bundles, so as to form a multi-wire yarn. However, indium wire of a size suitable as the core of the preform is priced at approximately $11,000 per pound. By comparison, indium metal in ingot form, as is suitable for the double crucible method, is priced at only about $650 per pound, resulting in a very significant saving. As of the filing of this application, both the rod-in-tube and double-crucible methods have been tested to the point of proof-of-concept.

Other aspects and advantages of the invention will appear as the discussion below proceeds.

BRIEF DESCRIPTION OF THE DRAWINGS

The invention will be better understood if reference is made to the accompanying drawings, in which.

DESCRIPTION OF THE PREFERRED EMBODIMENTS

Figure 1:
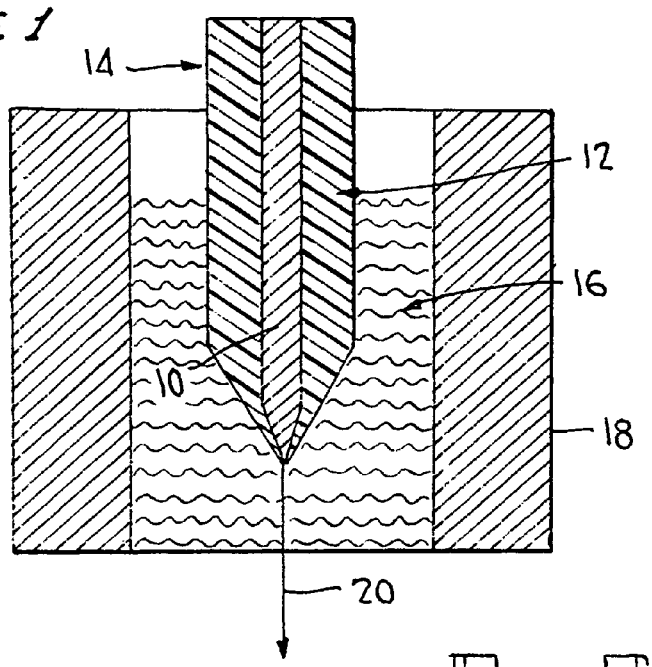
FIG. 1 shows schematically a cross-sectional view of apparatus for producing a filament comprising a codrawn metallic core and polymeric sheath from a rod-in-tube preform.

Conceptually, and as shown in FIG. 1, the method of the invention for producing microwires, that is, fine fibers comprising a metallic core in an insulative sheath, is not overly complex, although it goes contrary to the common practice of hundreds of years and doubtless thousands of man-hours expended in optimizing methods of manufacture of insulated electrical wire. That is, in all prior art of which the inventors are aware, insulated wire has been made by forming a metallic wire or filaments to a desired degree of fineness, optionally making a wire yarn of a number of individual filaments if a stranded wire is desired, and insulating the conductor, typically by extruding a polymeric coating over the previously formed metallic conductor or yarn.

By comparison, according to the present invention, the metallic conductor is formed simultaneously with the insulative sheath; the polymeric sheath essentially forms the "die" in which a continuous filament is formed of the molten metallic conductor material as the polymer and metal are codrawn from either a rod-in-tube precursor or employing the double-crucible arrangement. Indeed, there may be other ways of forming ultrafine insulated microwires by simultaneously coprocessing a low-melting-point metal within a higher-melting-point polymer sheath; these additional methods are also to be considered within the invention where not specifically excluded by the claims hereof.

As noted above, in order that a molten metal can be codrawn with a confining polymeric sheath, the metal must melt at a lower temperature than the polymeric sheath. While applicants cannot say that lower-melting-point metal conductors have never been insulated by a higher-melting-point polymer sheath, they are not aware of this having been done previously, and without doubt this arrangement is contrary to the vast experience of the wire manufacturing art.

Thus, as illustrated in FIG. 1, according to the invention a rod 10 of a relatively lower melting point metallic material of good electrical conductivity, and additionally exhibiting good solderability, high fatigue resistance, and substantial flexibility is disposed in a tube 12 of a relatively higher melting point polymeric material. This "preform" 14 is then exposed to heat, as indicated at 16, from a tube furnace 18 or other source. When the components of the preform 14 are properly heated, it is possible to simply grasp the tip of the preform and draw off a thin filament 20 comprising a metallic core in a polymeric sheath or "clad". The thin filament 20 thus formed can then be led over rollers, through inspection devices, and onto a take-up spool, all as discussed below in connection with FIG. 7.

Typically, the preform will be 0.200-0.375" in diameter; the filament 20 is drawn from the preform at an initial diameter, for example 0.010-0.030", and is drawn down to a final diameter, e.g., 0.0004-0.004" as it is elongated by the take-up spool and related equipment, while the relative proportions of the metallic conductor and insulative sheath remain constant. Thus, starting with a initial filament of a given diameter being drawn from the preform, the degree of elongation of the initial filament and thus the eventual diameter of the filament 20 can be controlled by the speed at which the elongated filament is wound on a spool. As will be apparent to those of skill in the art, most if not all of the elongation takes place in the first few inches of movement of the filament from the preform, while the metal core and polymer sheath remain relatively hot.

As noted above, it is within the scope of the invention to use a preform of a desired cross-sectional shape to form filaments of the same shape. For example, a cylindrical metal rod disposed in a cylindrical bore in a polymer casing of hexagonal external shape can be drawn to form a filament of hexagonal cross-section; a large number of such filaments can be packed more efficiently than round-sectioned filaments, which might be of use in manufacture of yarns comprising many microwire filaments. Further, a large number of such hexagonal-section microwires could be bundled together, perhaps in a polymer can, and further codrawn, to form even finer conductive filaments in a polymer matrix.

It will be apparent to those of skill in the art that proper control of the relative temperatures of the metallic core and the polymeric sheath materials is important to successful practice of the invention. In the FIG. 1 embodiment, which was used in initial testing of the invention, as described in detail in the Final Report, the tube furnace 18 comprised a metal tube heated by two 400-watt band heaters; this was satisfactory for heating an "Indalloy" indium alloy (detailed further below) rod 0.030" in diameter and one inch long, disposed in a 0.032" central hole formed in a polymer rod 0.34" in diameter. In this arrangement, as both the metallic rod and the polymer sheath material are heated by the same source, independent control of their heating is not possible. This was satisfactory for the proof-of-concept work done to date, but is unlikely to suffice for large-scale production operations.

More specifically, in testing of the "rod-in-tube" or "preform" method of practice of the invention, preforms were heated in a vertical tube furnace as described above, followed by hand drawing of the filament. The polymers used in these tests melted at approximately 525° F., and the metals at approximately 244-460° F. Note that the polymers in use are amorphous polymers and thus exhibit a range of melt temperatures at which they can be softened and "pulled", rather than a specific temperature at which they change from a solid to a liquid. In the FIG. 1 arrangement, heat must be conducted from the tube furnace to the rod by the polymer to melt the metal. The fact that insulative polymers are usually if not uniformly also poor conductors of heat means that this is not the optimal method of heating the metallic rod. Due to the substantial difference in melting temperatures, even relatively inefficient transfer of heat from the polymer to the metal was sufficient to melt the metal. Obviously, the optimum implementation would allow melting of the metal without heating the polymer to a temperature where it loses its strength.

Still more specifically, if both the polymer and metal core are to be heated in a single step, the polymer temperature may need to be raised above its optimum temperature for processing in order to melt the metal. Polymer strength goes down as the temperature goes up, resulting in insufficient strength in the polymer to "pull" the metal; this in turn can lead to the necking problems described in detail in connection with FIG. 2 below, or other failure mechanisms that may result in discontinuity of the metal core within the polymer sheath. In addition, because overheated polymer stretches significantly more than metal, there is a danger that the metal will not flow at sufficient speed to keep up with the polymer, again resulting in sections of fiber chat contain no metal.

Figure 2:
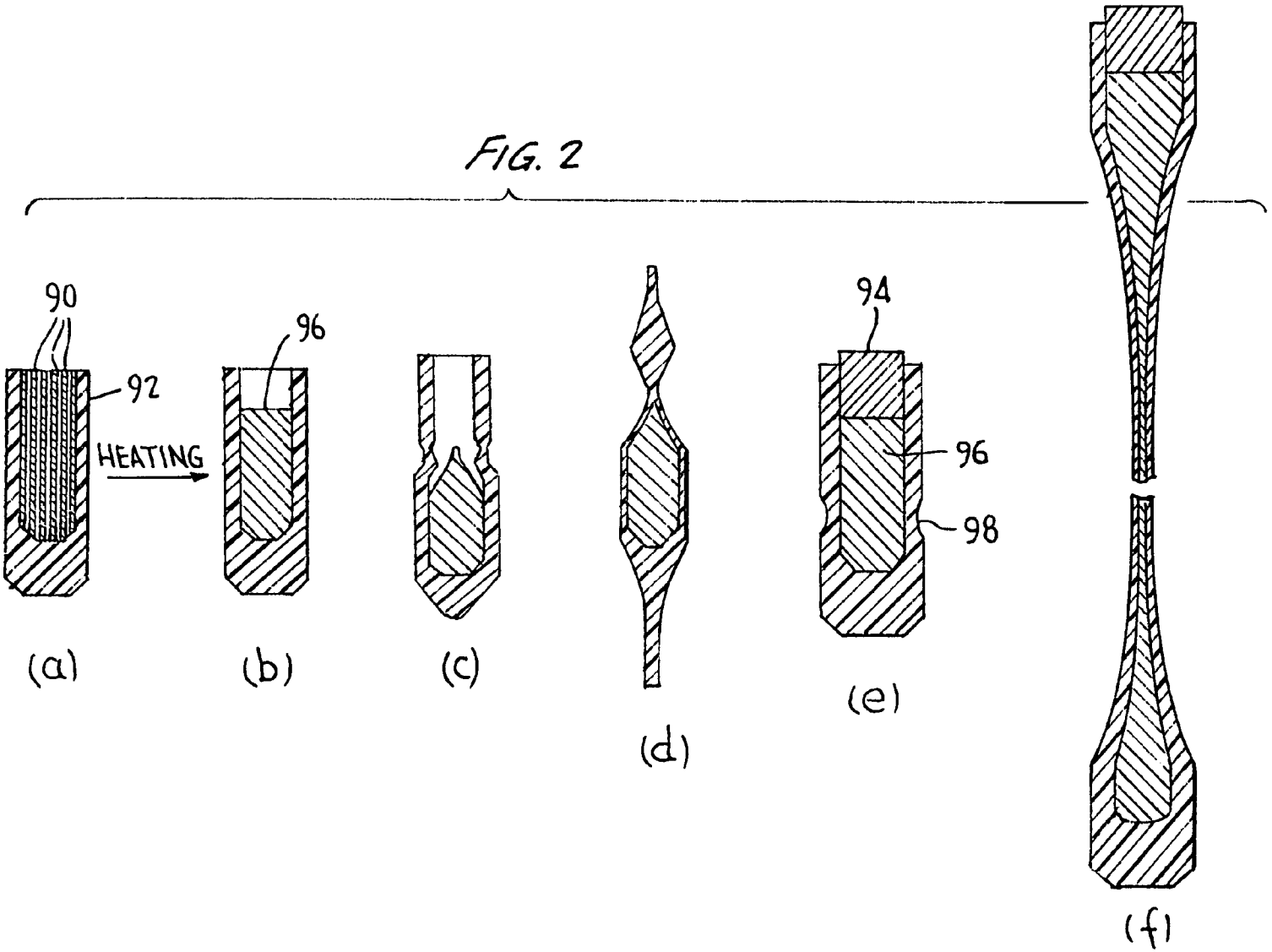
FIG. 2, comprising FIGS. 2 (*a*)-(*f*), depicts a "necking" problem that can occur when a relatively large-diameter metallic core is codrawn in a relatively thin-walled polymer shell, and illustrates one possible solution.

FIG. 2, comprising FIGS. 2(*a*)-(*f*), illustrates this necking problem and one possible solution. The necking problem was first encountered when an attempt was made to increase the ratio of core metal to polymer cladding by disposing 5 30-mil metal wires 90 in a closed-ended polymer tube 92 having a diameter of approximately 150 mils and a hole size of 96 mils, as illustrated in FIG. 2 (*a*). A first attempt to draw microwire from this preform was unsuccessful. Two conditions are believed to have contributed to this. When the center hole of the preform is relatively large (over 50% of its overall diameter), the polymer wall is relatively thin. When sufficient heat is applied to melt the metal wires, the polymer softens to the point that the thin wall becomes insufficiently strong to support the fiber drawing force. In addition, because there are spaces among the individual wires, when the metal is completely molten, as in FIG. 2(*b*), it does not fill the entire space occupied by the wires and a hollow preform section results. The hollow preform, having diminished wall strength because of thinness and heating, can easily form a "neck", as illustrated by FIG. 2(*c*), when drawing force is applied, and a failure of the tube wall can be initiated above the molten metal. When the polymer wall collapses, the metal is trapped below the necking point, but polymer without a metal core continues to be drawn from above the point at which the metal is trapped, resulting in the failure mode of the large-core preform shown in FIG. 2(*d*).

Two steps were taken to solve this problem, allowing microwire fiber to be successfully drawn. The first was to insert a solid metal bar 94 directly above the molten material 96, as shown in FIG. 2(*e*), plugging the open end of the bore in the polymer member, in order to support the weak area in which the necking occurred. However, because the metal bar 94 and the molten metal 96 were not actually attached, a weak spot still potentially existed in the juncture between the two. To address this, the polymer tube was notched, or "pre-necked", by cutting a circumferential groove around the polymer tube, as shown at 98 in FIG. 2(*e*). Thus forming a weakened ring around the polymer tube insured that necking would occur in a controlled manner, that is, commencing in an area containing molten metal 96. With the preformed neck 98, drawing force applied to the lower end of the preform caused the preform to start to be drawn at the neck until it formed a fiber, as illustrated in FIG. 2(*f*). Because fiber was drawn commencing from a point on the polymer tube containing metal, the presence of metal in the drawn fiber was assured. These tests were successful in producing fiber with a high ratio of core to clad. Conductivity test results from microwires drawn in these tests are given in Table 6 of the Final Report.

Figure 3:
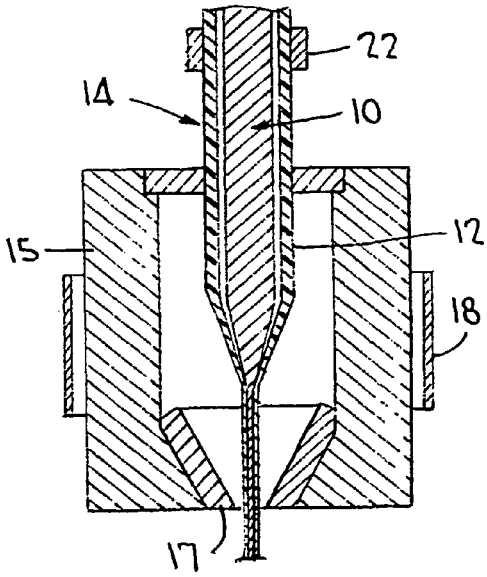
FIG. 3 shows a view similar to FIG. 1, illustrating one possible arrangement for separately heating the metal and polymer of the preform.
Figure 4:
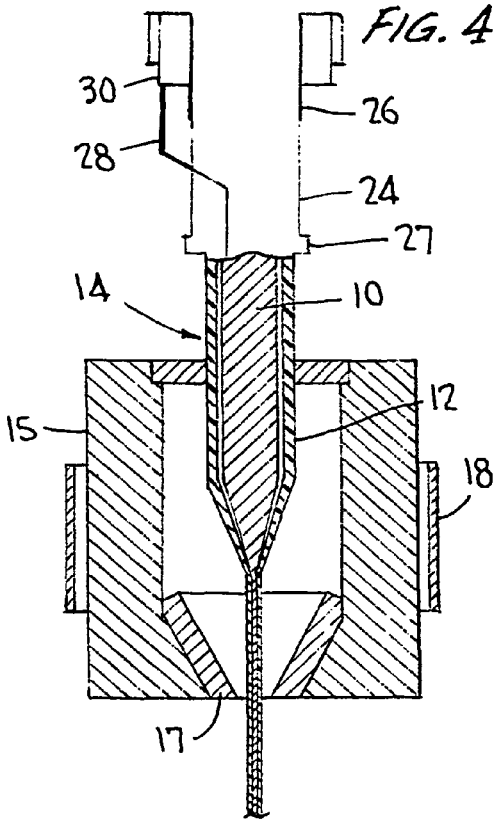
FIG. 4 shows a view similar to FIG. 3, illustrating a different heating arrangement.

It is anticipated that in the preferred practice of the invention the polymer and the metal will be heated by independently-controlled heating devices, so that each material can be heated to the optimum processing temperature, providing better temperature control and allowing optimization of the process. More specifically, FIGS. 3 and 4 show more sophisticated arrangements whereby the polymer and metal core can be heated separately, providing better control. In each, the preform 14 is disposed in an oven 15, and the polymer 12 can be melted, as in the FIG. 1 embodiment, by a vertical tube furnace 18. However, a separate heating device is added to separately heat the rod 10 of the metal intended to form the core. This can be done in several ways; in the two ways of doing so illustrated here, heat applied at the upper end of the core heats its tip.

In FIG. 3, an induction heater 22 is provided above the vertical tube furnace to selectively heat the metal without heating the polymer, as the non-conductive polymer is unaffected by electromagnetic energy emitted by an induction heater. In FIG. 4, a cartridge heater 30 is provided, which heats a member 28 of good heat conductivity such as a copper rod; member 28 is disposed in good heat transfer relation to the metallic rod 10, thus heating rod 10 separately from polymeric sheath material 12. The preform is supported by a metallic tube 24, with setscrews 27 retaining the preform therein; a ceramic insulator 26 is proved to avoid direct heating of tube 24 by cartridge heater 30. Other means of separately heating the metal and polymer will occur to those of skill in the art. In a further refinement, a metal cone 17 heated by, e.g., a cartridge heater (not shown), provides selective heating to the preform tip. This allows reduction of the amount of heat applied to the preform body, avoiding problems such as discussed in connection with FIG. 2.

Heating the metal 10 separately from the polymer 12 allows the metal to be completely molten, while the temperature of the polymer is such that while it is softened so as to be "drawable", it retains sufficient strength to "pull" the metal. Without limiting the invention to this particular theory of operation, it appears that as the polymer material is drawn out it effectively forms a fine tube; the molten metal then fills this tube by capillary action, forming a very fine filament. Separate control of the temperatures of the metal and polymer allows the metal to be heated to the point of fluidity, enhancing capillary action and allowing the metal to flow within the polymer, both of which are important to obtaining a consistent and uniform metal core.

It should also be appreciated that the word "melted" and its cognates, e.g., "molten", as used in reference to the process of the invention are to be read in context: that is, the metal is necessarily more completely transformed to the liquid state in order to flow within the tube formed by the polymer, which by comparison is softened but does not reach the liquid state.

It is within the scope of the invention to alter the characteristics of flow of the metal by adding different chemicals. For instance, the "flowability" characteristics of the metal might be drastically improved by coating the metal wire in a suitable flux, e.g., a soldering flux, prior to inserting it into the polymer preform. However, unless the flux is compatible with polymer, a weaker metal/polymer interface may result.

Figure 5:
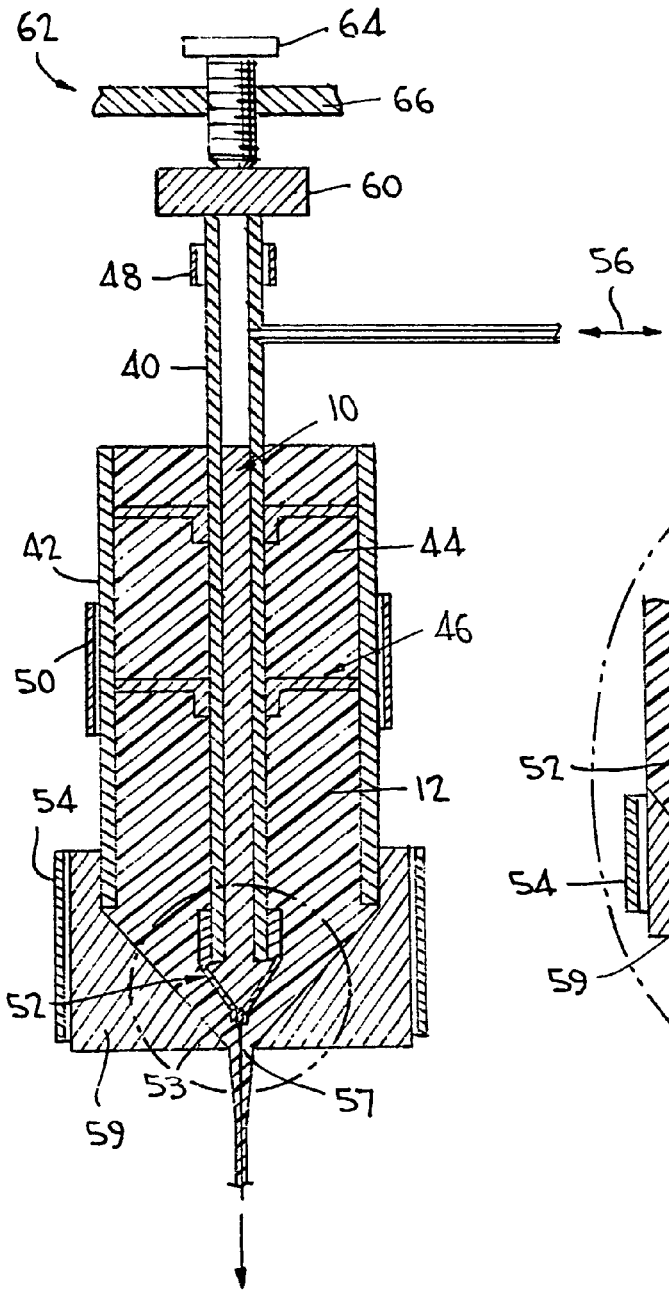
FIG. 5 shows a schematic cross-sectional view of a double-crucible embodiment of apparatus according to the invention for producing a filament comprising a codrawn metallic core in a polymeric sheath.
Figure 6:
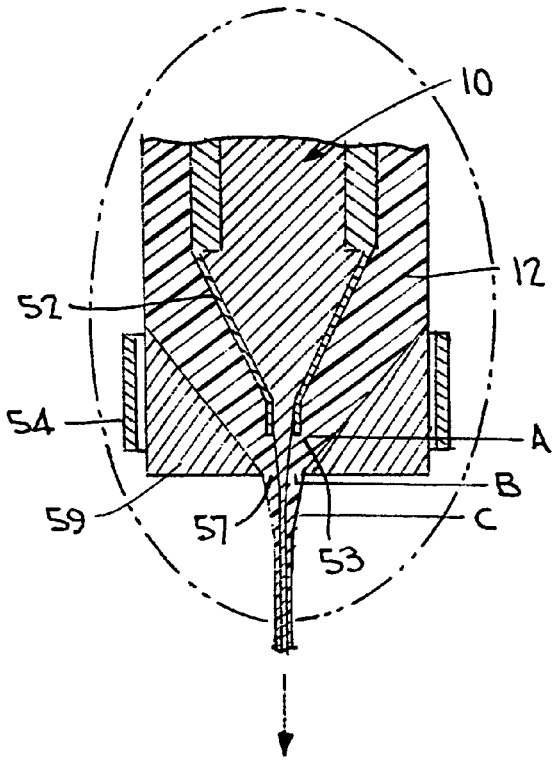
FIG. 6 is an enlarged view of a portion of FIG. 5.

The inventors have also performed initial tests showing that it is also possible to codraw a metallic central conductor and a polymer sheath using a "double-crucible" approach, as illustrated in FIGS. 5 and 6. In this embodiment of the invention, the metal 10 intended to become the conductive core is melted in an inner crucible 40, while the polymer 12 is melted in an outer crucible 42; an aligning device, possibly comprising upper and lower members 44 and 46, each comprising inner and outer rings spaced from one another, maintains the inner and outer crucibles in alignment. The inner crucible 40 and thereby the metal 10 that will become the conductor may be heated by a band heater 48 in contact with the inner crucible 40.

To ensure efficient heat transfer to the metal 10, while avoiding formation of undesired interalloy compositions, the inner crucible 40 can be made of a material that is a good heat conductor, that is of higher melting point than the polymer sheath or the indium core metal, and that does not react with indium, e.g., graphite, platinum, or possibly gold- or Teflon-coated steel. (If the metal is to be heated other than by heating of the crucible per se, for example by induction heating, the inner crucible need not be a good conductor of heat; in that case a ceramic material might be useful.) Apart from the cost issue, platinum might be a good initial choice. As the polymer is of higher melting point than the metal 10, the fact that the polymer will be in contact with the outer surface of the inner crucible does not present any difficulty.

The polymer 12 (which is typically supplied in granular form, so as to be conveniently poured into the upper end of the outer crucible) can be heated by a second band heater 50 in good thermal contact with the outer crucible 42, which can be made of aluminum, stainless steel or another convenient metal. The heat applied to the polymer pellets is controlled such that a thick liquid of tar-like consistency is formed which is suitable for practice of the invention.

A metallic tip 52 will typically be provided over the lower opening in inner crucible 40. Tip 52 will preferably be made readily replaceable, to allow ready adjustment of process parameters as desired. The outer crucible 42 may also be terminated by a replaceable tip 59, again in order to allow ready adjustment of process parameters for optimizing the process. A third band heater 54 may be provided to allow separate control of heating of the polymer in the vicinity of the tip 59.

As indicated by double-headed arrow 56, it may be desirable to apply compressed air, another gas, or vacuum to the interior of inner crucible 40, which is capped at 60 for the purpose. Provision of compressed air would be useful in controlling the flow of the molten metal; however, noting that molten indium can oxidize in the presence of oxygen, supply of a purging gas such as nitrogen might be preferable. Application of vacuum would slow flow of the metal. For example, one can readily envision beginning a long production run by first commencing drawing of the polymer, establishing stable drawing of in effect an elongated very small diameter tube, and then applying compressed gas at 56 to start flow of the molten metal. Compressed gas or vacuum can then be applied to control the rate of metal flow, e.g., responsive to control signals provided by downstream monitoring devices discussed in connection with FIG. 7. Compressed gas or vacuum might also be useful in controlling flow of the polymer as well.

FIG. 6 shows an enlarged view of the tip region of the double-crucible arrangement of FIG. 5. Three relative positions, labeled A, B, and C, are identified at which the molten metal in the inner crucible can be introduced into the stream of softened polymer being drawn from the outer crucible. This point can be controlled by allowing relative motion of the inner crucible 40 with respect to the outer crucible, as indicated schematically at 62, where an adjusting screw 64 threaded into a support member 66 controls the axial position of inner crucible 40. For example, as shown in FIG. 6, the orifice 53 of the inner crucible can be located such that molten metal is introduced to the polymer sheath inside the orifice 57 of the outer crucible (position A), outside the orifice 57 of the outer crucible (position C), or approximately at the minimum opening of the orifice 57 (position B).

It will be apparent that the relative diameters and relative positions of the orifices 53 in the inner crucible and 57 in the outer crucible must be selected carefully in order to control the relative dimensions of the core and sheath, so that the desired ratio of the diameter of the core to the overall diameter of the microwire is achieved.

More specifically, if the metal is released inside the outer crucible (that is, with the orifices in relative position A), the polymer into which the metal is released is relatively hot. This position appears to allow the stable flow of molten metal into a softened polymer sheath without application of external force, e.g., by way of compressed gas at 56. However, if the polymer is too soft, the polymer may not be able to support the molten metal column and most of the metal will be released uncontrollably. If the orifice 53 in the inner crucible tip is outside the orifice 57 of the outer tip (position C), metal can be released into a partially hardened polymer matrix, such that the polymer melt strength will be sufficient to stretch the molten metal. However, if the polymer is too hard, subsequently stretching the polymer/metal system to a very small diameter may be problematic. A good compromise might be found if both tips are substantially aligned with one another (position B). The optimal relative position, again, will be determined by experimentation with these as well as other relevant process parameters.

As noted, in addition to investigating the optimal point at which the metal is introduced into the polymer stream, a second parameter to be investigated is the relative sizes of the exit apertures of the outer and the inner crucibles. This parameter works in conjunction with the relative placement of the outer to inner crucible to assist in controlling the core/clad ratio, that is, to achieve the desired ratio of the diameter of the metal conductor to the overall filament diameter.

A third parameter to be investigated is the differential temperature between the metal and polymer, as well as their individual temperatures, which will likely affect the respective flow rates and thus the ratio of one to the other.

A further parameter to be investigated is the drawing rate, that is, the degree to which the fiber precursor exiting the orifices is drawn down and reduced in diameter by spooling at a high rate.

It will be appreciated by those of skill in the art that the viscosity of molten metal varies significantly with temperature, such that optimization of the metal temperature will be important in establishing optimal processing conditions. However, raising the temperature excessively may lead to oxidation of the metal, which in turn may require processing in a controlled atmosphere. Control of the surface tension of the molten metal may be desirable, and might be effected by provision of fluxing agents, but this in turn may affect the mechanical properties of the fiber, e.g. by interfering with the bond to be formed between the metal core and polymer sheath.

Experimentation intended to optimize the key process variables, e.g., relative sizes and spacing of the orifices, temperatures, pressure or vacuum applied, drawing rates, and other parameters is ongoing as of the filing of this application. Inner crucible orifices 53 of between 10 and 125 mils diameter were tested; preliminary results indicate that orifices of 50-75 mils for the inner crucible were suitable. The diameter of the orifice of the outer crucible appears to be less critical, being principally a factor in the thickness of polymer to be obtained. Successful tests were performed using an outer orifice diameter of 0.332" and an inner orifice diameter of 0.057", with the orifices in relative position B, that is, with the orifices substantially aligned with one another. Fiber of 2-4 mils final diameter was successfully drawn at a winding speed of 140-200 feet per minute using these parameters. Fiber was successfully drawn using both PC 6457 and PETG GN 007 as the polymer, with Indalloy 290 as the metal core. The band heater was set to 500-525 degrees F. during these tests. The temperatures of the polymer and metal were not directly measured during thses tests. However, preliminary testing with the inner crucible removed and the outer crucible entirely filled with polymer indicated that the temperature at the exit orifice was generally about 75 degrees F. less than the temperature of the band heater 54.

Further experimentation to establish optimal processing techniques and conditions as above, including separate control of the temperatures of the metal and polymer, and the application of an compressed gas stream or vacuum to the inner and/or outer crucibles in order to increase or decrease the amount of molten metal and polymer discharge, is considered within the skill of the art.

It is also within the invention to apply heat to the filament after initial formation, e.g., by pulling the filament through a tubular oven, so as to keep the metal/polymer filament hot, allowing further reduction in diameter by elongation than would be possible if the filament were substantially immediately cooled by the ambient air.

Figures 7A, 7B, 7C:
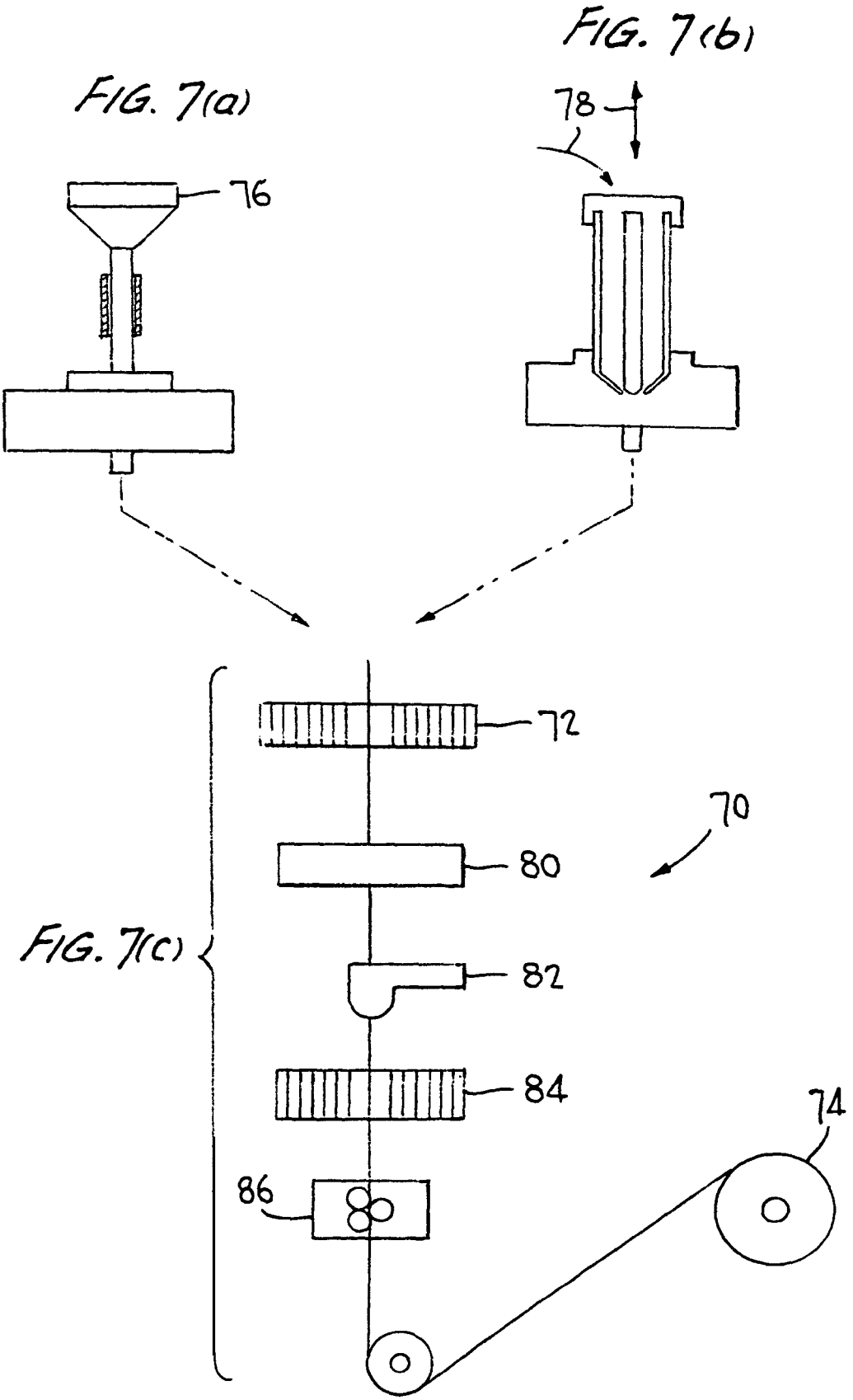
FIG. 7, comprising FIGS. 7 (*a*)-(*c*), shows schematically a tower arrangement for mass production of filaments according to the invention, with both the rod-in-tube and double-crucible alternatives being shown.

It is contemplated that scaling up the laboratory work performed thus far to a production-scale operation will best be accomplished by construction of a fiber drawing tower 70, using, where applicable, equipment and techniques known in the manufacture of optical fiber. FIG. 7(*c*) shows schematically the basic components now envisioned for such a tower; as illustrated, either the rod-in-tube method, indicated at FIG. 7(*a*), or the double crucible arrangement, indicated at FIG. 7(*b*), may be employed for fiber formation, followed by monitoring and control instrumentation and by material handling equipment, such as spoolers and the like.

It is envisioned that the wire quality can be effectively and continuously monitored by providing four principal instruments as part of the fiber drawing tower 70. The first is a micro-wire diameter monitor 72 that will ensure that the diameter of the fiber remains constant at a desired size, e.g., 25 microns. This monitor provides information to the take-up roller assembly 74, which controls the speed of the process. That is, as noted considerable elongation and corresponding reduction in diameter of the polymer/metal system will take place after initial formation, due to tension applied by the take-up roller assembly 74. The wire diameter monitor 72 also provides information to a computerized preform feeder 76, if the rod-in-tube method is employed, to supply additional metal and polymer to the crucibles, or to apply compressed air or vacuum, as indicated at 78, to either of both of the inner and outer crucibles, if the double-crucible method is employed, to increase or decrease the feed depending on the speed of the draw.

The second, third, and fourth instruments may not necessarily be used to control other portions of the machine, but may be employed to provide alerts when the process has moved beyond acceptable tolerance limits. The second instrument, a metal core continuity detector 80, will detect any discontinuity in the metal core. The third instrument is a core/clad ratio detector 82, to determine whether the desired core/clad ratio is being properly maintained. The fourth instrument is a core/clad concentricity monitor 84 to insure that the fiber is round and that the insulative sheath is satisfactorily uniform. Finally, tension of the fiber is monitored and controlled by a tension monitor 86.

Identifying a suitable micro-wire diameter monitor 72 is a straightforward task. There are many companies from whom this type of equipment, as used in the fiber-optic industry, can be obtained and evaluated.

The metal core continuity detector 80 is required in order to insure that the fiber being drawn contains a consistent metal core. Three methods of metal core detecting are currently contemplated: laser scanning, capacitance measurements, and methods based on magnetic properties such as very low frequency pulse induction, and beat-frequency oscillation. In order to choose the best approach, it will be necessary to obtain equipment operating using each of these methods and to evaluate their capabilities by running trials at different speeds using prototype yarns.

Two possible approaches to implementing a core/clad ratio detector 82 are now under consideration. The first involves illuminating the fiber with a laser beam and monitoring passage of the beam with a CCD camera or the like. Optical inspection of the metallic core would be effective because the polymers preferred for the insulative sheath of the micro-wire are transparent. The laser can "see" through the polymer to the core, such that an optical detector on the opposite side of the fiber from the laser can image the conductive core. Such a device is available from the same companies that produce fiber-diameter detector sensors. A second method measures reflected light, again by means of a CCD camera. Devices that appear likely to be useful are available from manufacturers of commercial machine vision systems, e.g., Elbet Vision System and Systronics.

A core/clad concentricity monitor 84 can operate on the same technologies described above for the core/clad ratio detector, that is, the combination of a laser and a CCD camera. In both cases, the laser would illuminate the fiber and the CCD camera would capture the data, and computer software would be used to convert the data to core/clad ratio and core/clad concentricity information. The functions of instruments 82 and 84 could also be performed by a single instrument.

As discussed above, the microwires of the invention can be used in various ways, depending on the final product desired. Multi-filament yarns can be created using the micro-wire fibers. Multi-filament yarns will carry higher current than single filament yarns, and will also facilitate creating a reliable interface with connectors. Twisting and core-wrapping are two potential methods of producing multi-filament yarns using microwire fibers according to the invention.

The microwires of the invention can be combined with other multifilaments as desired to produce desired yarn characteristics, e.g., modulus, tensile strength, and bulk, and to conceal and protect the microwires. Multi-filament, twisted yarns might desirably be made from either 100% microwire fiber, or of some blend of microwire fibers and textile grade polymeric fibers, possibly 50% microwire fiber and 50% polyester. A polyester/microwire blended yarn is expected to better satisfy the requirements involved in weaving than a yarn consisting only of the microwire fibers. To create a 100% microwire yarn, 30 "ends" (i.e., individual fibers) of microwire fiber can be used. For a 50/50 blend, 15 ends of microwire fiber can be twisted with one end of 70 denier multi-filament polyester yarn. The 100% microwire yarn can be expected to have higher conductivity for the same size yarn when compared to the blend, and, when attaching a connector, it would have higher probability of connecting with the metal core. On the other hand, the blend can be expected to be more durable and to possess more satisfactory textile processing qualities.

A "bundle" comprising multiple ends of microwire fiber (approximately 15 ends) can also be wrapped or cross-wrapped with two ends of 40 denier multi-filament polyester yarn. Wrapping is a simpler and less costly process, whereas cross-wrapping would provide more coverage to the microwire bundle, and therefore, more protection. Contrasting twisted versus core-wrapped yarns, the former is a fast and economical method of producing yarns, whereas the latter would be expected to produce a more durable yarn and to optimize both current transference and reliability when interfacing with connectors.

Once an optimum conductive yarn (single or multiple ends) is identified, it can be integrated into a fabric by weaving or by knitting. For example, to make a woven fabric, 150 denier polyester yarns might be used as the warp, and the micro-wire yarns or yarn blend as the filling. For knitted fabrics, a single stitch knitting method can be exploited to incorporate the micro-wire yarn or yarn blend into a fabric. This knitted method produces continuous conducting fiber throughout the fabric.

Both woven and knitted fabrics can be produced in order to address a range of military and commercial applications. Woven material is likely to be more appropriate for military or higher durability applications, whereas knitted fabric is likely to be more appropriate for consumer goods such as heated gloves and undergarments.

It will be self-evident that proper selection of the materials of the metal core and of the polymer sheath is essential to successful implementation of the invention. The Final Report incorporated herein by reference above details the selection process fully, and is summarized here for completeness of this application. Of course, the invention is not to be limited by the work performed or contemplated, nor to the materials mentioned herein.

Polymer selection must be done carefully to satisfy certain end product and processing requirements:

- Is the polymer suitable for textile applications?
- Can the selected polymer withstand repeated textile cleaning cycles?
- Does the polymer exhibit the necessary melt behavior at a suitable temperature to enable its use in the rod-in-tube method or the double-crucible method?
- Is the polymer rheology, specifically the "melt flow index" at a suitable pressure and temperature, of the polymer suitable for micro-fiber drawing? A "melt flow index" (this term being used generally in the art) of between 6 and 14 is recommended for fiber drawing.
- Is the polymer transparent, so as to allow optical inspection of core continuity? (If not, X-ray or high energy electromagnetic beam methods can be used for fiber inspection.)

As detailed further in the Final Report, a series of polymers were melted and tested for their ability to form micro-fibers. The initial investigation included the following polymers, each being melted and fibers drawn from the molten bath.

- Polycarbonates (Bayer Macrolon series 3100, 3103, 6457)
- Acrylics (Autofina—Altuglas VO52, DR 101, MI7)
- Polyesters and modified polyesters (Eastman chemical PCTG, Provista, GN 007, PETG 6763, and PETG with heat stabilizers)
- Polyurethanes (Dow Pellethane 2102-90AE and 2102 65D)
- Nylon (EMS Grilamid L20GHS)
- Bayer Polyethers, PE
- Inomers (Bayer Texin 990, DuPont Surlyn 8920, DuPont Engage 8440)

Focusing on ease of use and end use suitability, two polymer families were selected for further testing, namely, polycarbonate and glycol-modified polyethylene terephthalate (PETG). A few hundred yards of continuous fibers were drawn using R&D scale equipment. To ensure mass production suitability, a few thousand yards of one polymer were drawn on commercial equipment.

Polycarbonates demonstrate high strength, toughness, heat resistance, chemical resistance and excellent physical property stability. Flame retardants can also be added to polycarbonate without significant loss of physical properties.

Two different grades of Bayer polycarbonate products, Bayer Macrolon 3103 and Bayer Macrolon 6457, were chosen for their superior melt characteristics, strength, and transparency, and for their ability to form fibers. The chemical structures of these polymers are similar but contain different additives to provide specific properties to the end product. Other polycarbonates might also be useful, but it is to be noted that certain polycarbonates may not withstand hot water, raising wet processing issues to consider for garments made of polycarbonate.

Polycarbonates are long-chain linear polyesters of carbonic acid and dihydric phenols, such as bisphenol A. The presence of the phenyl groups on the molecular chain and the two methyl side groups contribute to molecular strength. In addition, the attraction of the phenyl groups between different molecules contributes to a lack of mobility of the individual molecules resulting in good thermal resistance and relatively high viscosity (i.e., low melt flow) needed for the process of the invention. The lack of mobility also prevents the polycarbonate from developing a significant crystalline structure, thus providing light transparency.

Glycol-modified polyethylene terephthalate, or PETG, was also considered because of suitable melt behavior and adaptability in a textile environment. PETG is a copolyester, clear amorphous thermoplastic with 90% light transmission. PETG has been known for over 40 years and its utility in the textile industry, including military textiles, is proven. The PETG polymer comes in many forms containing different additives, including heat stabilizers. These modified polymer systems are slightly more expensive but provide desired engineering properties. The incorporation of glycol modifiers minimizes the brittleness of polyethylene terephthalate (PET) and provides a flexible fiber that can be woven into conformable fabrics. Unstressed PETG exhibits good resistance to dilute aqueous solutions of mineral acids, bases, salts, and soaps. PETG also has good resistance to aliphatic hydrocarbons, alcohols, and a variety of oils. Halogenated hydrocarbons, low molecular weight ketones, and aromatic hydrocarbons dissolve or swell this polymer. PETG has many features similar to PVC with similar temperature resistance and durability. PETG has found a market where customers are looking to produce an "environmentally" friendly product. Considering cost and overall performance, testing was performed using two Eastman Chemical polyethylene terephthalate (PETG) polymers, PETG 6763 and PETG GN007.

Testing detailed in the Final Report clearly demonstrated that Macralon 3103, Macralon 6457 and PETG GN 007 are relatively easy to draw, can be drawn to very small diameter, and fall within acceptable limits for fiber production with regard to other properties considered. These three polymers were therefore chosen for initial testing.

The metal to be used to form the conductor of the microwires of the invention must likewise satisfy certain criteria. Since most metals melt at temperatures over 1000° F., much higher than polymer melting temperatures, only a limited number of metals are available for this work. This limited number is further narrowed down by the electrical and crystalline structure requirements. Therefore, the metal must be selected with thorough understanding of both metal characteristics and the physical properties of the end product. The following issues were considered during metal selection.

- Does the metal have sufficient electrical conductivity (maximum resistivity 9 micro-ohm-cm)?
- Does the metal melt at a much lower temperature than the polymer melting/drawing temperature?
- Does the crystalline structure of the metal contain a sufficient number of slip planes to provide high ductility at lower temperatures?
- Are the surface tension characteristics of the molten metal such as to provide suitable flow and wetting properties at the polymer/metal interface?
- Does the metal-polymer system require surfactants to modify the contact angle at the polymer/metal interface?
- Does the selected metal have a good strain/cyclic fatigue resistance?
- Does the metal solder easily?
- Can the metal form connections that are strong enough to hold electronic components?
- Is the metal user friendly, containing no toxic materials such as lead or cadmium?
- Is the metal affordable?

During the metal selection process, special consideration was given to four major characteristics: melt temperature (considering both liquidus temperature $T_{m,l}$ and solidus temperature $T_{m,s}$), ability to stretch (% elongation at ultimate tensile strength), resistivity (% resistivity relative to copper) and the thermodynamics of metal melting (as illustrated by phase diagrams). After a careful literature search, the inventors initially proposed the metals listed below, which satisfy all the concerns mentioned above. All of these metals were purchased from Indium Corporation of America (ICA) and are identified herein by ICA's product designator "Indalloy" followed by a number that indicates the composition of the alloy; the actual constituents are listed below, together with their liquidus and solidus melting points, $T_{m,l}$ and $T_{m,s}$ respectively, in degrees F. Note that all of ICA's metals are called Indalloy, even though two of the products evaluated (Indalloy 121 and Indalloy 241) do not actually contain indium, and although Indalloy 4 is actually pure indium; note further that the constituent percentages given below all refer to percentages by weight.

Indalloy 4—pure indium ($T_{m,s}$—314 F, $T_{m,l}$—314 F)

Indalloy 290—97% indium, 3% silver-290 F, $T_{m,s}$—290 F)

Indalloy 3—90% indium, 10% silver($T_{m,s}$—289 F, $T_{m,l}$—459 F)

Indalloy 1E—52% indium, 48% tin ($T_{m,s}$—244 F, $T_{m,l}$—244 F)

Indalloy 121—96.5% tin, 3.5% silver ($T_{m,s}$—430 F, $T_{m,l}$—430 F)

Indalloy 241—95.5% tin, 3.8% silver, 0.7% copper($T_{m,s}$—423 F, $T_{m,l}$—428 F)

As further detailed in the Final Report, the rod-in-tube method of FIG. 1 was employed to test various combinations of metals and polymers. The test procedure was essentially as follows. Polymer rods of 0.34" diameter were prepared in a vertical pipe extruder, sectioned to about 1 inch in length, and drilled using a 32 mil drill bit in a high speed drilling machine. 30 mil Indalloy wires were cleaned by dissolving the outer layer of metal in 5-10% hydrochloric acid for 1-5 minutes and then washing the metal in acetone. Next, the wires were inserted into the center holes of the polymer rods, forming metal-centered polymer preforms. These were then placed in a vertical metal oven comprising two 400-W band heaters, and heated until the tips reached their melting point. When this occurred, the tips were drawn down to produce microwires.

More specifically, even if one starts with a square-ended preform, when melting commences, it becomes pointed as shown in FIG. 1. It appears useful to heat the preform in the vicinity of its tip, e.g., by a conical heater 17 in FIG. 4. Once the polymer starts to melt, it is ready to flow and one can grip the pointed tip of the preform with a pair of pliers, pull it to a take-up spool 74 (FIG. 7) and commence drawing of the microwire. To assure the presence of metal, the preform can be prenotched as at 98 in FIG. 2(*e*).

In order to understand the compatibility of polymer and metal alloys, a series of trials were conducted using three different polymers, and a selection of metal alloys. The polymers chosen for the trials were Macrolon 3103, Macrolon 6457, and PETG GN007. Of the 6 metals listed above, Indalloy 4 (100% Indium), Indalloy 290 (97% Indium/3% silver), Indalloy 3 (90% Indium/10% silver) and Indalloy 121 (96.5% tin/3.5% silver) were selected as the initial metals for evaluation. Observations and comments from these trials are listed below.

Indalloy 121 (Eliminated from further testing)

- Melts at relatively high temperatures (430+° F.)
- Both liquidus and solidus temperatures are the same, i.e., there is no liquid phase below 430° F.
- At relatively high temperatures where metal softens, a strong polymer can stretch the softened metal to form ribbon shaped wires.
- At moderate temperatures, where the polymer melts but the core metal stays hard, the metal wire tends to anchor the polymer around it. This results in skin drawing around the metal wire where preform diameter reduces significantly. It also results in an end product that does not contain metal.
- Unless the tip temperature is high, fiber tends to break at the un-molten metal tip.
- Selection of optimum temperature is difficult and needs more attention.
- Unless a very high temperature polymer is considered, the metal is not easy to draw. This may not be the best metal composition to be used in this project.
- Eliminated from further testing because of low conductivity (16% of Cu) and high melt temperature.

Indalloy 3 (Eliminated from further testing)

- Has a very wide liquidus-solidus window ($T_{m,s}$—289 F, $T_{m,l}$—459 F). A wide window can be advantageous or disadvantageous depending upon the polymer processing conditions.
- At 500°-600° F. processing temperatures, the core wire temperature stayed below the liquidus temperature (459° F.) and the preform wire stayed at a semi-solid state.

During the fiber draw process, the molten portion of the metal tends to stretch nicely, yet the metal that is not molten tends to resist stretching, causing thick and thin sections.

Above 600° F., the polymer melts very quickly and the core wire temperature reaches approaches its liquidus temperature. However, the wire temperature still stays below liquidus. At these temperatures, the polymer loses its melt strength and the effectiveness of drawing diminishes.

The end products have many thick and thin sections which are not acceptable.

Eliminated from the list of potential metals.

However, it is possible that some of the technical difficulties causing this potential choice for the core metal to be eliminated from initial testing might be resolved by heating the metal core independently from the polymer body, as illustrated in connection with FIGS. 3 and 4, or by use of the double-crucible method.

Indalloy 290 (Selected for further testing)

Melts very easily. ($T_{m,s}$—290 F, $T_{m,l}$—290 F)

At processing temperatures above 500° F., metal wire melts and stays very liquid. In the liquid stage, metal tends to ball up to reduce its surface free energy. During fiber drawing, the liquid metal flows very nicely with the polymer.

Capillary action seems to drive the molten metal through the center of the tube formed by drawing the polymer and produces a uniform metal core.

Very consistent and uniform core (no thick and thin sections).

Produced very nice sample at processing temperatures above 500° F. (For polycarbonate 525-540 ° F. appears optimal, while for PETG 500-525° F. is best.)

Satisfies all the required criteria to produce an electro-textile.

Worth pursuing further in both preform drawing and double crucible method.

Cost is $23.36 per gram, and a minimum order is 50 grams.

Indalloy 4 (Pure Indium) (Selected for further testing)

Melts at very low polymer processing temperatures.

Can be used with all three selected polymers (Macrolon 3103, Macrolon 6457, and PETG).

At processing temperatures above 500° F., metal melts and flows very nicely in the polymer center.

Fine wires with very uniform core can be produced.

Worth pursuing in both preform and double crucible methods.

Cost is $25.95 per gram, and a minimum order is 50 grams.

As indicated, the conductivity of Indalloy 121 is somewhat lower than the required conductivity values for this project. In addition, Indalloy 121 melts at a relatively high temperature and is less compatible with the selected polymers. Indalloy 121 was thus eliminated from further consideration.

Similarly, Indalloy 3 demonstrates a very wide liquidus-solidus window. Consequently, at low processing temperatures, the un-molten portion of the metal tends to form thick and thin spots in the drawn product. Unless the processing conditions are changed drastically (e.g., perhaps by selectively applying intense heat to the tip of the preform, or by heating the core using an independent heater, as illustrated in FIG. 4), this alloy is not suitable for practice of the invention. Consequently, Indalloy 3 was eliminated from further testing.

The experimental observations together with metal characteristics indicated that at least two metals tested thus far (Indalloy 290 and Indalloy 4) are user friendly and can be utilized to produce the micro-wires of interest. Both Indalloy 4 (100% indium) and Indalloy 290 (eutectic indium-silver) melt at very low temperatures (below 315° F.), and can be melted at polymer processing temperatures. These two alloys also satisfy the conductivity requirements needed for this work. They are relatively compatible with the selected polymers and can be easily drawn. When the metal is encapsulated and heated in the polymer preform, the molten metal follows the shape of the center hole. When the polymer is drawn to small diameter fiber, the metal stays trapped in the center hole resulting in a very uniform conductive center core.

Central to mass production of the desired micro-wires is the combined performance of the down-selected polymer and metals. After several trials, the initial set of polymer/metal combinations were reduced to combinations of three potential polymers (Macrolon 3103, Macrolon 6457 and PETG GN 007) and two indium alloys (Indalloy 290 and Indalloy 4). The performance of these three polymers in combination with the various metals can be summarized as follows.

Macrolon—PC 3103 and Indium Alloys

Polymer very transparent (88% transmission) allowing the metal core to be visible through an optical microscope. Easy to detect core continuity.

The particulate material as supplied needs to be dried at 250 F for at least 4 hours before use or bubbles may appear in the molten polymer bath.

The polymer exhibits high-melt strength, so that the polymer can force the core metal to stretch during drawing.

The polymer melts at relatively high temperatures, at which the core metal can be completely melted.

Unless the preform tip is heated separately, or is heated more than the remainder of the preform, the "skin drawing" effect can be problematic. This is a condition in which softened polymer is drawn from around the metal core while the center of the preform is not drawn. This phenomenon can be triggered by several factors, including high polymer melt strength. If the core metal is not melted, it tends to anchor the polymer around it and the skin draw effect becomes prominent. As noted, by concentrating the heating at the tip, skin draw can be avoided and fiber successfully drawn.

This polymer is reported to have a low MFI of 6.5 g/10 sec at 300° C. at 1.2 Kg. Melts and flows well around 525° -575° F. (best at 540° F.) where metal core melts completely.

High heat is needed in a continuous production where preform is continuously inserted into the oven.

PC 3103 plus Indalloy 4 or Indalloy 290 can be a good combination to produce micro-wires of about 2-3 mils (50-75 microns).

Macrolon—PC 6457 and Indium Alloys

The polymer is very sensitive to humidity, so that the particulate material as supplied must be dried at 250° F. for 4 hours prior to use. If not dried, bubbles form and the drawn fiber becomes relatively opaque and streaky.

The polymer flows at temperatures above 500° F. and thus can be drawn above the melting temperature of Indalloy 4 or Indalloy 290.

Reported to have medium melt strength at fiber drawing temperature of 525°-540° F. During fiber drawing, the preform skin is not pulled as hard as in Macrolon 3103, resulting in less skin draw effect.

Can be drawn to very small diameter fibers (1-2 mil)

Good polymer to work with. The polymer has balanced properties of melt temperature, MFI, and melt strength.

Excellent performance both with Indalloy 4 or Indalloy 290

PETG GN 007 and Indium Alloys

- Very transparent polymer (90% transmission). The metal core is visible through an optical microscope. Easy to detect core continuity.
- Again, the particulate polymer material needs to be thoroughly dried, e.g., at 180° F. for 6 hours.
- Polymer has been previously selected for military clothing industry by a major military contractor.
- Melts at lower temperatures (below 500° F.)
- Very low melt strength around 500° F. Polymer may need heat stabilizer to enhance the melt temperature.
- Can be drawn very well at low temperatures and can be drawn to very small diameter fibers (0.5-2 mil).
- If heated zones are appropriately adjusted, both metal wire and preform tip (polymer) can be melted simultaneously and good wires can be drawn.
- If the heated zones are not adjusted properly, fiber drawing can be very difficult. Preform necking and chunking can be problematic.
- Excellent performance with Indalloy 290.

As above, therefore, the inventors' experimental observations clearly show that any combination of the polymer systems (PC 3103, PC 6457, GN 007) and indium alloys (Indalloy 4 and Indalloy 290) included in experimental trials work very well in the rod and tube method. Any or all of these combinations may also work well in the double crucible technique. Each selected polymer/metal system provides different physical properties, so that the final selection must be made according to the end product requirements. The combinations of GN 007 or PC 6457 polymer system with Indalloy 290 or Indalloy 4 appear suitable for initial commercialization; each of these composite systems are relatively easy to process to form very fine wires. The invention of course is not to be thus limited.

Indium is relatively expensive, and the cost of indium or indium alloys depends on the quantity ordered and the physical form of the material. 30 mil indium wire costs approximately $25 per gram (about $25,000 per kilogram or $11,350 per pound). This wire was used in making the rod-in-tube preforms used in tests performed to date. However, indium in ingot form (14 mm deep×29 mm wide×149 mm long) costs significantly less at $1.45 per gram (about $1450 per kilogram or $658 per pound) than indium wire, which is a 95% price reduction. In large scale production, large diameter indium rods which can easily be formed from indium ingots can be employed in scaled-up rod-in-tube preforms. Further, since the shape of the metal does not play a role in the double crucible method, indium in ingot form can be easily used in this implementation. In either implementation, the use of indium ingots can be exploited to reduce the cost of the end product significantly, allowing indium to be used.

Experiments were also carried out using Indalloy 121, an alloy of 96.5% tin and 3.5% silver, in order to try to identify a material that might be acceptable at lower cost than the indium alloys otherwise preferred. This material was successfully processed, as described above. Therefore, although this material's conductivity is somewhat low comparative to indium and its alloys (Indalloy 121 tin/silver alloy is 6.2 times more resistant than copper, while the indium alloys can be as low as 4.2 times more resistant than copper), the cost of the material is very attractive. Indalloy 121 ingots cost about $0.06 per gram ($60.50 per kilogram or $27.50 per pound).

Therefore, although the price of indium ingots is far better than the price of formed wires ($1.45 per gram for ingots versus $25 per gram for wire), and though the tin/silver alloy exhibits somewhat lower conductivity than the objective, the price of the tin/silver alloys is so attractive ($0.06 per gram in comparison to $1.45 per gram for indium ingot metal) that the use of Indalloy 121 tin/silver alloy according to the invention may make certain end uses of the wires of the invention feasible where the cost of indium alloys would make the products impracticably expensive, and where moderately higher electrical resistance than copper is acceptable.

Ultimately, a successful method of connecting the micro-wires of the invention to various sorts of devices will be required in order to achieve useful wearable electronics. Although development of commercially viable connection technology was not within the scope of the project under which this invention was made, the inventors nonetheless needed to achieve connectivity to a measuring device in order to evaluate the conductivity of the micro-wires and to assist in determining the continuity of the metal core in the wire. The primary goal was to develop a reliable method of exposing the core metal to enable a connection, without causing damage to the core.

Four methods of achieving a connection to the metal core of the micro-wire have been considered to date: a micro-pin system, an epoxy system, and two methods of removing the polymer sheath. The first two methods are fairly sophisticated, have not been tested, and are discussed below for completeness. Two methods of removing the polymer sheath were tested, as described below.

Depending upon the polymer sheath hardness (or brittleness), reliable connections to the microwires of the invention can potentially be achieved by a micro-pin system that punctures through the polymer coating, akin to a staple having a larger wire attached thereto, although this becomes increasingly difficult as relatively small (less than 50 microns) wires are employed. Where the metal core is less than 10 microns in diameter, the pin system must be much smaller than the core diameter of 10 microns to reduce the risk of electrical failure at the connecting point. A micro-pin system meeting these requirements has not yet been developed. Clearly, if the microwires of the invention were processed into multiconductor yarns, the odds of making good connections with one or several of the filaments using a micro-pin connector would be increased dramatically as compared with a single-filament conductor. If only signal-level currents were required to be carried, this method of making connection to the micro-wires of the invention might well be adequate.

Another method of connection that may prove satisfactory after development is to encapsulate the end of a micro-wire (or the ends of a micro-wire bundle) in an epoxy matrix and then polish the epoxy-encapsulated end to expose the micro-wires. The polished epoxy end can then be gold plated, and a connecting wire soldered thereto, establishing a connection to the core of the wire. Comparable techniques are commonly used in metallurgy when examining material under a scanning electron microscope (SEM).

A first attempt to remove the polymer sheath from the metal core utilized heat. A heated soldering iron tip was dragged across the micro-wire in an effort to deform the polymer sheath thermally. This effort was not successful. Since the polymer melts at a higher temperature than the metal, the heated tip damaged the metal core even before the polymer was partially removed. If the tip is too sharp, the tip tends to cut the metal wire while it is removing the polymer layer. In a related experiment, a heated metal bar was pushed against the micro-wire in an attempt to reach the metal core without damaging it. This was also unsuccessful. If the bar diameter was too big, the molten polymer together with the metal core was pushed away and establishing a connection to the metal core was nearly impossible.

Chemical methods of removing the polymer sheath, that is, using a chemical solvent to dissolve the polymer sheath, leaving the core untouched, proved to be more successful. The connection can then be made by soldering, possibly preceded by the epoxy-encapsulation and plating steps discussed above. A list of tested chemicals, microscopic observations, and comments are given in Table 5 of the Final Report. Of the chemicals tested, three chemicals (methylene chloride, ethylene dichloride, and N-methylpyrollidone) were ultimately used successfully to remove the outer core sheaths formed of each of Macrolon 3103, Macrolon 6457, and PETG GN007. The aggressiveness of these chemicals vary from high to low with methylene chloride being the most aggressive and N-methylpyrollidone the least. If the microwires were below 2 mils, the cleaning was done using the least aggressive chemical.

Those of skill in the art will recognize that numerous additions and improvements can be made to the method of the invention, and to the products produced thereby, without departure from its essential spirit and scope. Accordingly, while several preferred and alternative embodiments of the invention have been disclosed in detail, the invention should not be limited thereby, but only by the following claims.

What is claimed is:

1. A method for making an insulated microwire comprising an electrically conductive metallic core and an insulative polymer sheath, comprising the steps of:

selecting a metal of suitably high electrical conductivity and of relatively low melting point;

selecting a polymer of relatively high melting point;

forming an assembly of at least one elongated solid member of said metal in one or more bores in an elongated solid member of said polymer;

supporting the assembly of said solid member of said polymer and said at least one solid member of said metal such that the axes of elongation thereof are oriented vertically;

forming a weakened portion of said solid member of said polymer above a lower extremity of said assembly;

heating said metal and said polymer such that said metal is substantially liquefied while said polymer is softened; and codrawing said polymer and said metal simultaneously by applying downward force to said lower extremity of said assembly, such that the assembly of said solid member of said polymer and said at least one solid member of said metal commences elongation at said weakened portion of said solid member of said polymer, and so that said polymer forms an elongated tube sheathing a continuous filament of said metal;

connecting said elongated tube of polymer sheathing an elongated filament of said metal to a take-up reel; and employing said take-up reel to further elongate and reel up said elongated tube of polymer sheathing an elongated filament of said metal;

whereby a microwire comprising a metal core in a polymer sheath is formed.

2. The method of claim 1, wherein said metal is selected from the group consisting of indium and its alloys, and alloys of tin with silver.

3. The method of claim 1, wherein said polymer is selected from the group consisting of polycarbonate and glycol-modified polyethylene terephthalate.

4. The method of claim 1, wherein a plurality of wires of said metal are disposed within a bore in said solid member of said polymer.

5. The method of claim 1, comprising the further step of forming said at least one bore by drilling into a solid member of said polymer without penetrating therethrough, so as to form a bore with one closed end.

6. The method of claim 1, wherein said metal and said polymer are separately heated.

7. The method of claim 1, comprising the further step of processing one or a plurality of the microwires thus made to form a yarn.

8. The method of claim 7, wherein said yarn additionally includes ends of other materials selected to provide desired characteristics to the yarn.

9. The method of claim 1, wherein the cross-sectional dimension of said assembly is reduced by at least about 5000% in formation of said microwire.

* * * * *